US009114544B2

(12) United States Patent
Shida et al.

(10) Patent No.: US 9,114,544 B2
(45) Date of Patent: Aug. 25, 2015

(54) CUTTING DEVICE AND IMAGE FORMING SYSTEM

(71) Applicant: Konica Minolta, Inc., Tokyo (JP)

(72) Inventors: Toshio Shida, Higashiyamato (JP); Takuya Akabori, Higashimurayama (JP); Ritsuo Fujii, Hachioji (JP); Masaaki Ikeda, Hachioji (JP); Hitoshi Uchida, Kyoto (JP)

(73) Assignee: KONICA MINOLTA, INC. (JP)

( * ) Notice: Subject to any disclaimer, the term of this patent is extended or adjusted under 35 U.S.C. 154(b) by 97 days.

(21) Appl. No.: 13/864,786

(22) Filed: Apr. 17, 2013

(65) Prior Publication Data

US 2013/0279963 A1 Oct. 24, 2013

(30) Foreign Application Priority Data

Apr. 20, 2012 (JP) ..... 2012-096263

(51) Int. Cl.

| | |
|---|---|
| ***B26D 5/02*** | (2006.01) |
| ***B26D 1/08*** | (2006.01) |
| ***B26D 5/14*** | (2006.01) |
| ***B26D 7/01*** | (2006.01) |
| *B26D 7/00* | (2006.01) |

(52) U.S. Cl.

CPC .. *B26D 5/02* (2013.01); *B26D 1/08* (2013.01); *B26D 5/14* (2013.01); *B26D 7/015* (2013.01); *B26D 2007/005* (2013.01); *B26D 2007/0056* (2013.01); *B26D 2007/0081* (2013.01); *Y10T 83/8749* (2015.04)

(58) Field of Classification Search

CPC ..... B26D 1/08; B26D 5/14; B26D 7/015; B26D 5/02; B26D 2007/0056; B26D 2007/0081; B26D 2007/005

USPC ..... 400/621; 412/16; 399/407, 408, 410; 83/934, 564, 601, 627, 642, 646, 83/356.2; 101/226

See application file for complete search history.

(56) References Cited

U.S. PATENT DOCUMENTS

| | | | | |
|---|---|---|---|---|
| 8,459,888 | B2 * | 6/2013 | Shirotori et al. | 400/621 |
| 2004/0096256 | A1 * | 5/2004 | Hayashi et al. | 400/621 |

FOREIGN PATENT DOCUMENTS

| | | | |
|---|---|---|---|
| JP | 2003-305907 | A | 10/2003 |
| JP | 2007-268744 | A | 10/2007 |
| JP | 2008-30131 | A | 2/2008 |
| JP | 2008-30143 | A | 2/2008 |

OTHER PUBLICATIONS

Notification of Reasons for Refusal for Japanese Patent Application No. 2012-096263, mailed Mar. 25, 2014. English translation attached.

* cited by examiner

*Primary Examiner* — Blake A Tankersley
(74) *Attorney, Agent, or Firm* — Cantor Colburn LLP

(57) ABSTRACT

A cutting device includes a main body unit and a support unit. The main body unit includes a cutting unit on a lower side. The cutting unit cuts off an edge portion of paper. The support unit supports the main body unit in such a way that the main body unit rotates. The main body unit exposes a blade of the cutting unit at least on a lateral side by rotating.

6 Claims, 10 Drawing Sheets

CUTTING DEVICE AND IMAGE FORMING SYSTEM

CROSS REFERENCE TO RELATED APPLICATIONS

The present invention claims priority under 35 U.S.C. §119 to Japanese Application No. 2012-096263 filed Apr. 20, 2012, the entire content of which is incorporated herein by reference.

BACKGROUND OF THE INVENTION

1. Field of the Invention

The present invention relates to a cutting device and an image forming system.

2. Description of the Related Art

In order to create a booklet by superposing sheets of paper on which images are formed by an image forming device, cutting processing to cut off some edge portions of the booklet is performed in general. By the cutting processing, margins of sheets which constitute a booklet can be aligned.

As a cutting device to perform the above-described cutting processing, as disclosed in Japanese Patent Application Laid-Open Publication No. 2008-30131 or Japanese Patent Application Laid-Open Publication No. 2008-30143, there is known a cutting device which cuts off edge portions of a booklet with a blade disposed at a lower part of a case. The cutting device makes the blade, which is disposed along a horizontal direction, abut a booklet, which is held along a vertical direction, so as to cut off an edge portion of the booklet.

By the way, it is unavoidable that a blade is degraded because the blade is repeatedly used. Hence, the blade is regularly replaced with another blade.

However, in a conventional cutting device, a blade is disposed at a lower part of a case, namely, on the lower side of the cutting device. Hence, it is difficult to replace the blade with another blade from the upper side or the lateral sides of the cutting device. More specifically, in order for a maintenance person to safely replace a blade with another blade, the maintenance person needs to see the blade before replacing the blade with another blade. However, to see a blade of a conventional cutting device, a maintenance person needs to get under the cutting device, the bottom of which is lifted. Hence, work efficiency is low.

BRIEF SUMMARY OF THE INVENTION

The present invention is made in view of the circumstances, and objects of the present invention include providing a cutting device and an image forming system each of which makes it easy to replace a blade with another blade.

In order to achieve at least one of the objects, according to an aspect of the present invention, there is provided a cutting device including: a main body unit including a cutting unit on a lower side, the cutting unit which cuts off an edge portion of paper; a support unit which supports the main body unit in such a way that the main body unit rotates, wherein the main body unit exposes a blade of the cutting unit at least on a lateral side by rotating.

Preferably, in the cutting device, the main body unit makes the edge portion, which is cut off by the cutting unit, come out of the main body unit downward so as to cut off the edge portion downward.

Preferably, in the cutting device, the blade faces upward in response to the main body unit rotating to expose the cutting unit on the lateral side.

Preferably, in the cutting device, the blade includes two blades which face each other, in response to the main body unit being at a first rotation angle, one of the blades faces upward, and in response to the main body unit being at a second rotation angle, the other of the blades faces upward.

Preferably, in the cutting device, the first rotation angle and the second rotation angle are rotation angles to which the main body unit rotates about 90 degrees from a reference rotation angle of the main body unit in different directions, the reference rotation angle at which the cutting unit is disposed on the lower side.

Preferably, in the cutting device, the support unit supports the main body unit via a rotation shaft which passes through the center of gravity or near the center of gravity of the main body unit in such a way that the main body unit rotates.

BRIEF DESCRIPTION OF THE SEVERAL VIEWS OF THE DRAWING

The present invention is fully understood from the detailed description given hereinafter and the accompanying drawings, which are given byway of illustration only, and thus are not intended to limit the present invention, wherein.

DETAILED DESCRIPTION OF THE INVENTION

In the following, an embodiment of the present invention is described with reference to the drawings. The embodiment includes various technically-preferred limitations to realize the present invention. However, the scope of the present invention is not limited to the embodiment or the drawings.

Figure 1:
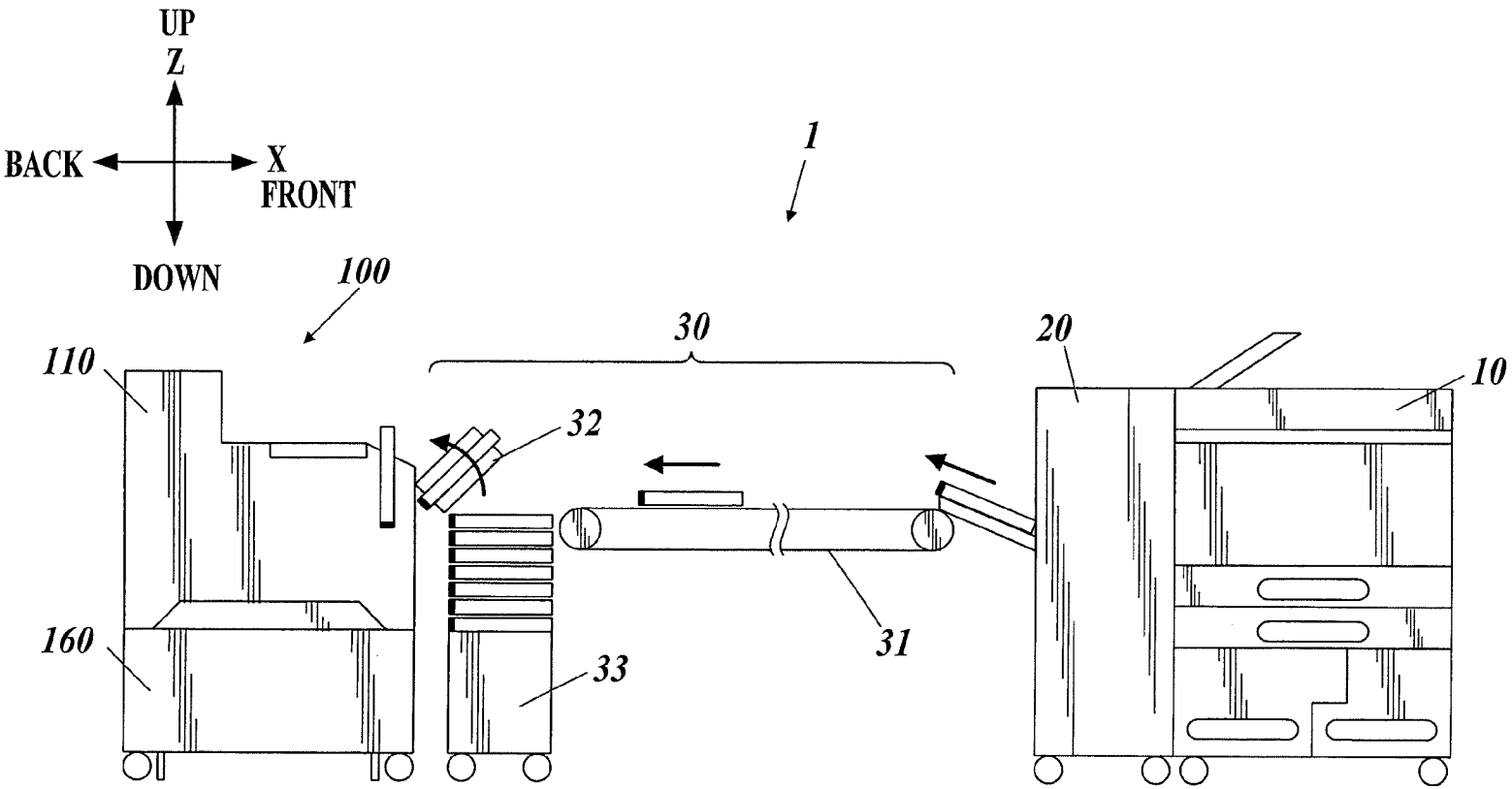
FIG. 1 shows main components of an image forming system in accordance with an embodiment of the present invention.

FIG. 1 shows main components of an image forming system 1 in accordance with an embodiment of the present invention.

The image forming system 1 includes an image forming device 10, a paper processing device 20, a carrier device 30 and a cutting device 100.

The image forming device 10 forms images on sheets of paper.

More specifically, the image forming device 10 includes a carrier unit, a developer unit, a primary transfer unit, a secondary transfer unit, a fixation unit and an ejection unit so as to form images on sheets of paper. The carrier unit takes out sheets of paper stored in a paper tray as a recording medium and carries the paper. The developer unit develops toner images corresponding to bitmap data on a primary transfer member such as a transfer roller. The primary transfer unit transfers the toner images developed on the primary transfer member to a secondary transfer member such as a transfer drum. The secondary transfer unit transfers the toner images transferred to the secondary transfer member to the paper carried by the carrier unit. The fixation unit fixes the toner images, which are transferred to the paper, on the paper. The ejection unit ejects the paper on which the toner images are fixed by the fixation unit.

The image forming device 10 delivers the paper on which the images are formed and ejected therefrom to the paper processing device 20.

The paper processing device 20 creates a booklet from the sheets of the paper on which the images are formed by the image forming device 10.

More specifically, the paper processing device 20 includes a stapling unit, a gluing unit and an ejection unit, for example. The stapling unit staples the sheets of the paper delivered from the image forming device 10 so as to make a booklet. The gluing unit glues the spine side of the booklet, on which the stapling is performed, so as to put a cover. The paper processing device 20 can eject the sheets of the paper delivered from the image forming device 10 without performing the stapling.

The above-described method for creating a booklet by the paper processing device 20 is an example, and hence not limited thereto. For example, the paper processing device 20 may omit the stapling, and instead glue a spine side of a bundle of sheets and wrap the bundle in a cover so as to create a booklet.

The carrier device 30 carries booklets or sheets (a booklet or booklets, hereinafter) ejected from the paper processing device 20 to the cutting device 100.

More specifically, for example, as shown in FIG. 1, the carrier device 30 includes a belt conveyer mechanism unit 31, a delivery unit 32 and a standby unit 33, and places booklets on a belt so as to carry the booklets from the carrier device 30 to the cutting device 100. The belt conveyer mechanism unit 31 carries booklets in a predetermined direction. The delivery unit 32 displaces each booklet in such a way that the paper surfaces thereof are along a vertical direction, the booklet which is carried by the belt conveyer mechanism unit 31 with the paper surfaces thereof along a horizontal direction, and delivers the booklet to the cutting device 100. The standby unit 33 puts booklets on standby until the delivery unit 32 delivers the booklets to the cutting device 100.

The cutting device 100 performs cutting processing to cut edge portions of booklets and various types of processing related to the cutting processing.

The image forming system 1 of the embodiment is an image forming system to (i) form images on sheets of paper, (ii) bundle the sheets, on which images are formed, so as to create a booklet, and (iii) cut off edge portions of the booklet with the cutting device 100.

Figure 2:
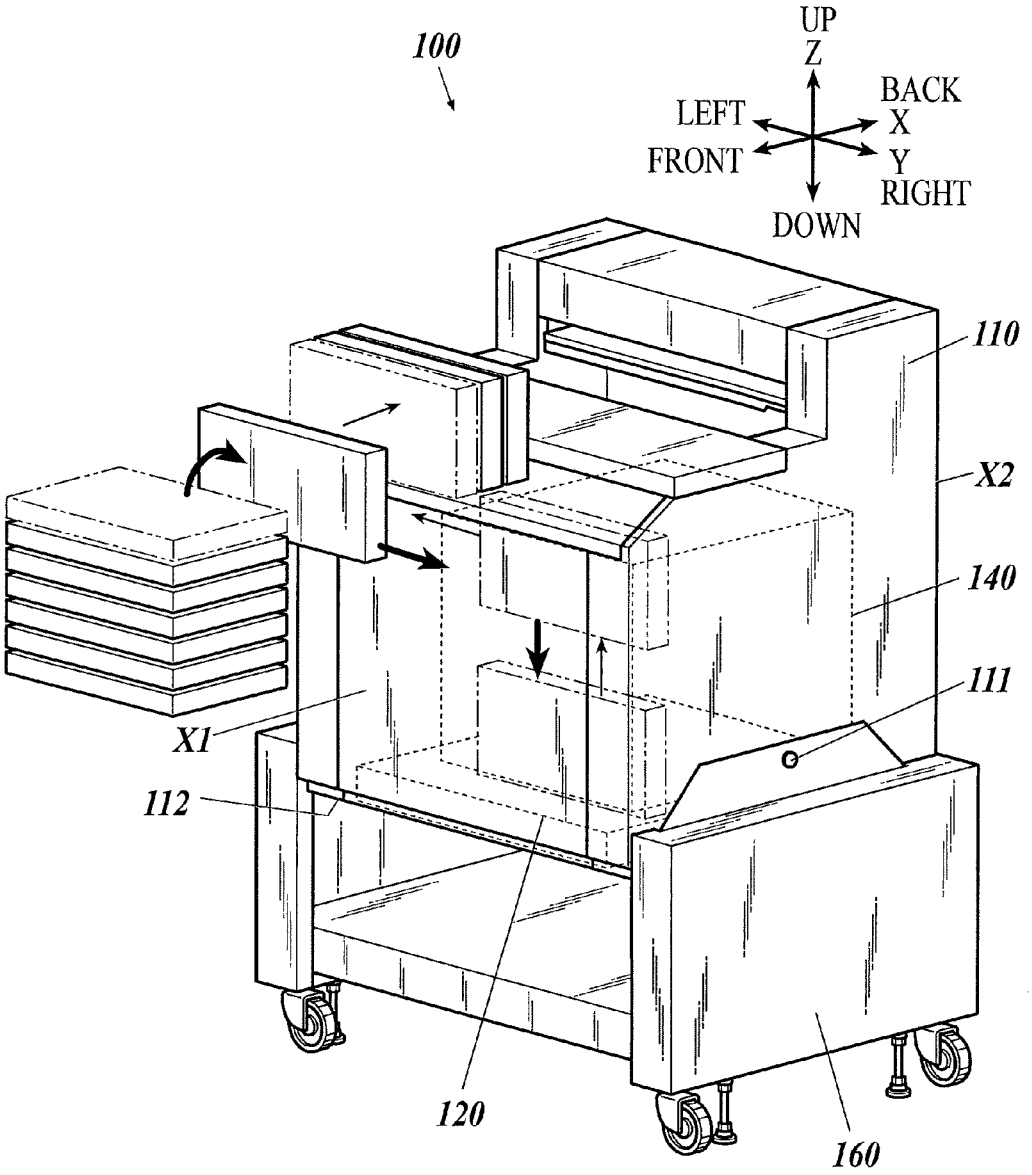
FIG. 2 is a perspective view of a cutting device.

FIG. 2 is a perspective view of the cutting device 100.

The cutting device 100 includes a main body unit 110 and a support unit 160. The main body unit 110 includes a cutting unit 120 and a carrier unit 140. The cutting unit 120 cuts off edge portions of a booklet. The carrier unit 140 keeps the booklet carried from the carrier device 30, and carries the booklet to the cutting unit 120. The support unit 160 supports the main body unit 110 in such a way that the main body unit 110 rotates.

The main body unit 110 is configured to expose blades 121 and 122 of the cutting unit 120 disposed on a lower side (i.e. at a lower part of the main body unit) at least on a lateral side.

In the following, when change of rotation angles of the main body unit 110 is explained, an angle of the main body unit 110 of the cutting device 100 shown in FIG. 2 is regarded as a reference rotation angle. The reference rotation angle of the main body unit 110 shown in FIG. 2 is a rotation angle (cutting rotation angle) at which an edge portion of a booklet is cut off downward by the cutting unit 120. The edge portion to be cut off by the cutting unit 120 is made to come out of the main body unit 110 downward.

As shown in FIGS. 1 and 2, the vertical direction is a Z direction, and, of the horizontal direction, a direction along a direction in which booklets are carried by the belt conveyer mechanism unit 31 of the carrier device 30 to the cutting device 100 is an X direction, and a direction being at right angles to the Z direction and the X direction is a Y direction. In the X direction, a side to which booklets are carried to the cutting device 100 is the front side, and its opposite side is the back side. The right side and the left side are determined in the Y direction for convenience. Their correspondence relationship is shown in FIGS. 2 to 4.

A lateral surface of the main body unit 110 on the front side and a lateral surface thereof on the back side when the main body unit 110 is at the cutting rotation angle shown in FIG. 2 are a lateral surface X1 and a lateral surface X2, respectively.

As shown in FIG. 2, the support unit 160 supports the main body unit 110 in such a way that the main body unit 110 rotates via a rotation shaft 111 disposed on lateral surfaces of the main body unit 110, the lateral surfaces being at right angles to the lateral surfaces X1 and X2 and a bottom 112. That is, a rotational center axis of the main body unit 110 is along the Y direction.

Figure 3:
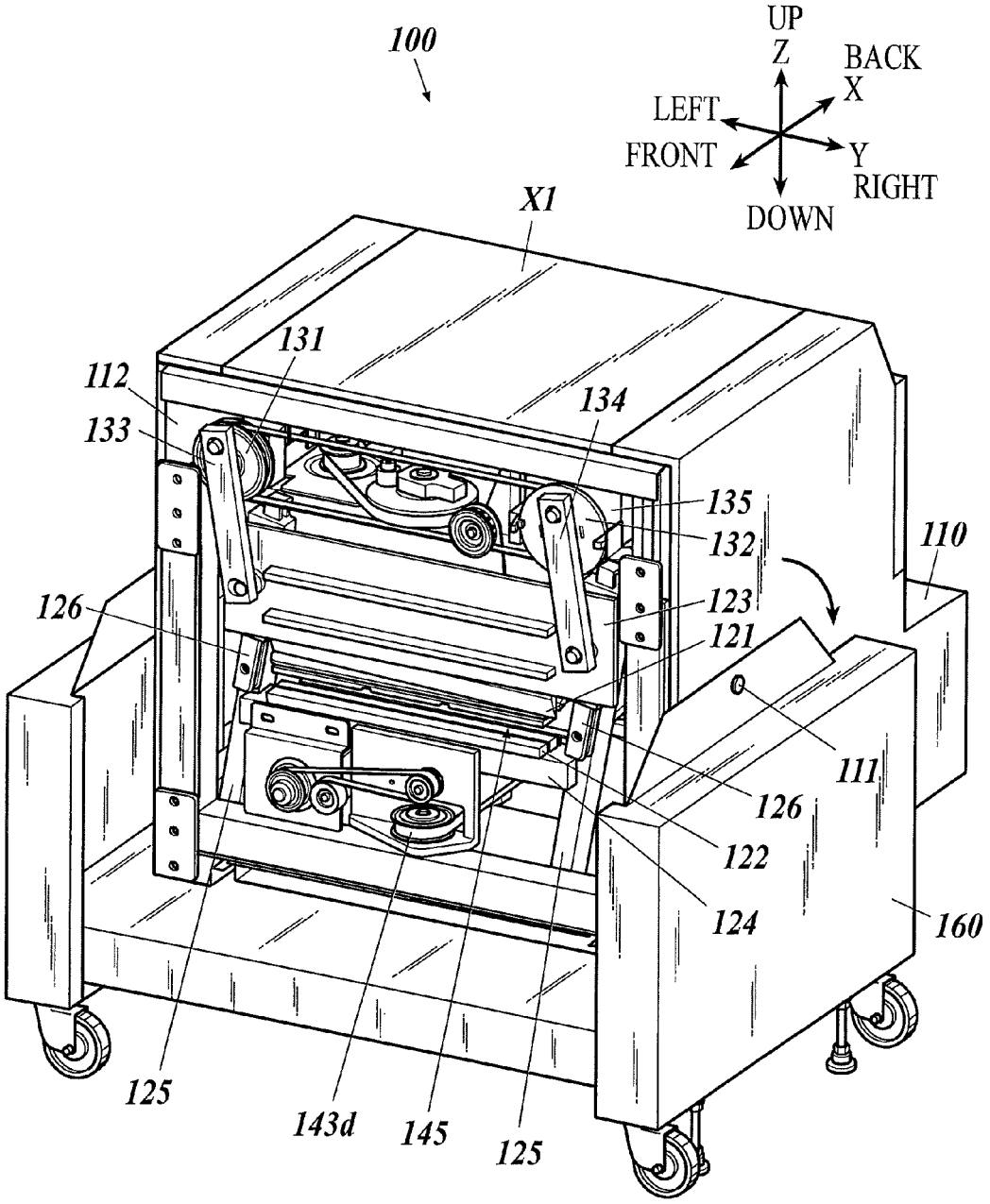
FIG. 3 is a perspective view of the cutting device at a first rotation angle at which a main body unit exposes blades of a cutting unit on a lateral side.
Figure 4:
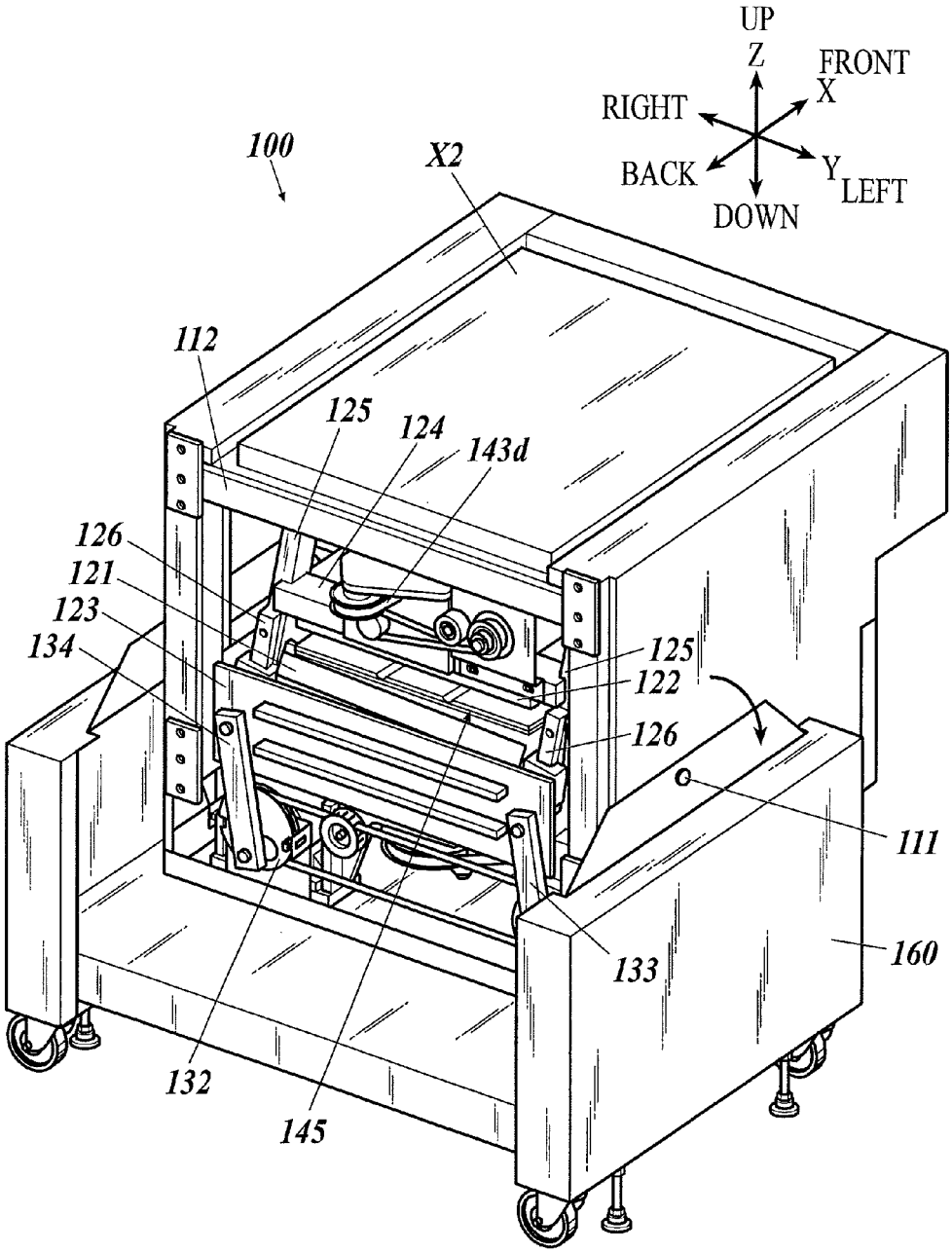
FIG. 4 is a perspective view of the cutting device at a second rotation angle at which the main body unit exposes the blades of the cutting unit on a lateral side.

FIGS. 3 and 4 are perspective views each showing the cutting device 100 at a rotation angle at which the main body unit 110 exposes the blades 121 and 122 of the cutting unit 120 on a lateral side. FIG. 3 is a perspective view of the cutting device 100 viewed from the front side while FIG. 4 is a perspective view thereof viewed from the back side.

As shown in FIG. 3, the main body unit 110 rotates in such a way that the lateral surface X1 is positioned on the upper side. The main body unit 110 is in a state in which the blades 121 and 122 of the cutting unit 120 are exposed on a lateral side (front side) at a first rotation angle at which the lateral surface X1 is positioned on the upper side.

As shown in FIG. 4, the main body unit 110 also rotates in such a way that the lateral surface X2 is positioned on the upper side. The main body unit 110 is in a state in which the blades 121 and 122 of the cutting unit 120 are exposed on a lateral side (back side) at a second rotation angle at which the lateral surface X2 is positioned on the upper side.

As shown in FIGS. 3 and 4, the bottom 112 of the main body unit 110 does not have a wall-type cover member, and accordingly is open. Consequently, the components (units and the like) inside the main body unit 110, such as the components of the cutting unit 120, are exposed.

As shown in FIGS. 3 and 4, by rotating the main body unit 110 in such away that the bottom 112 is positioned on a lateral side (i.e. a lateral side of the cutting device 100), the bottom 112 can be accessed from the lateral side of the cutting device 100. Accordingly, a replacement operation of the blades 121 and 122 of the cutting unit 120 disposed on the lower side at the cutting rotation angle can be performed from the lateral side of the cutting device 100, the lateral side on which the bottom 112 is positioned by the rotation of the main body unit 110.

Here, the cutting unit 120 is described.

The cutting unit 120 includes two blades, namely, the blades 121 and 122, which face each other.

Each of the blades 121 and 122 is a plate-shaped member, the longitudinal direction of which is along the Y direction.

More specifically, each of the blades 121 and 122 is a plate-shaped member disposed along the bottom 112 of the main body unit 110. That is, at the cutting rotation angle shown in FIG. 2, the blades 121 and 122 are along the horizontal direction (an X-Y plane), and at the rotation angles shown in FIGS. 3 and 4, the blades 121 and 122 are along a Y-Z plane.

At least one (the blade 121, for example) of the blades 121 and 122 has a cutting edge at one side of two sides of the blade in the longitudinal direction thereof. The other side of the blade 121 in the longitudinal direction is held by a holding unit 123, and the other side of the blade 122 in the longitudinal direction is held by a holding unit 124.

The holding units 123 and 124 respectively hold the above-described other sides of the blades 121 and 122 in such a way that the blades 121 and 122 are along the bottom 112 of the main body unit 110. The holding units 123 and 124 respectively hold the blades 121 and 122 in such away that the blades 121 and 122 face each other too.

The holding unit 124 is fixed to a predetermine point of the main body unit 110. Accordingly, the blade 122 held by the holding unit 124 is fixed to the predetermined point of the main body unit 110.

The holding unit 123 moves the blade 121 close to and away from the blade 122.

More specifically, on the bottom 112 of the main body unit 110, two prismatic support members 125 disposed along the bottom 112 and parallel to each other are disposed. The holding unit 124 is disposed between the two support members 125, whereby the holding unit 124 forms the shape of "H" on the bottom 112 with the two support members 125.

As shown in FIGS. 3 and 4, the two support members 125 are disposed to each have a predetermined inclination toward a direction being at right angles to the lateral surfaces X1 and X2.

On a side (a bottom 112 side) of each of the two support members 125, the side close to (i.e. facing) the bottom 112, a guide rail 126 is disposed. The guide rails 126 are disposed along an extending direction in which the two support members 125 run, and engage with the plate-shaped holding unit 123, which is along the bottom 112, so as to guide movement of the holding unit 123. That is, the holding unit 123 moves along the extending direction of the two support members 125 provided with the guide rails 126.

The holding unit 123 is connected to a blade movement mechanism unit including eccentric cams 131 and 132, connecting members 133 and 134 and a drive unit 135. The connecting members 133 and 134 respectively connect the eccentric cams 131 and 132 to the holding unit 123. The drive unit 135 rotates the eccentric cams 131 and 132. The holding unit 123 moves along the guide rails 126 in response to an operation of the blade movement mechanism unit. Consequently, the blade 121 held by the holding unit 123 moves close to or away from the blade 122 held by the holding unit 124. At the time when the blade 121 is close to the blade 122, the blades 121 and 122 slide, so that an edge portion of a booklet sandwiched between the blades 121 and 122 is cut off.

In each of FIGS. 3 and 4, the bottom 112 of the main body unit 110 is positioned on a lateral side (the front side or the back side). Accordingly, the blades 121 and 122 face the lateral side. However, at the cutting rotation angle shown in FIG. 2, the bottom 112 is positioned on the lower side and along the horizontal direction. Accordingly, the blades 121 and 122 are along the horizontal direction, and a moving direction of the blade 121 is the horizontal direction too. That is, when the main body unit 110 is at the cutting rotation angle shown in FIG. 2, the cutting unit 120 makes an edge portion of a booklet come out of the main body unit 110 downward through the blades 121 and 122 so as to cut off the edge portion downward.

As shown in FIG. 2, there is a space between the bottom 112 of the main body unit 110 at the cutting rotation angle and the support unit 160. At the cutting rotation angle, edge portions of booklets cut off by the cutting unit 120 drop through the space and are piled on the support unit 160. That is, the support unit 160 has a function to accumulate edge portions of booklets, the edge portions which are cut off to be discarded.

The space between the bottom 112 of the main body unit 110 and the support unit 160 also has a function to prevent the lower ends of the lateral surfaces X1 and X2 of the main body unit 110 from hitting the support unit 160 when the main body unit 110 rotates from the cutting rotation angle as shown in FIGS. 3 and 4.

Replacement of the blades 121 and 122 of the cutting unit 120 with other blades is performed when the cutting device 100 is not in operation. That is, the rotation angles of the main body unit 110 shown in FIGS. 3 and 4, the rotation angles at which the replacement of the blades 121 and 122 can be performed, are rotation angles (no-cutting rotation angle) at which the cutting device 100 is not in operation.

In other words, the main body unit 110 can change the cutting rotation angle and the no-cutting rotation angle, at which the blades 121 and 122 are exposed on a lateral side.

The first rotation angle shown in FIG. 3 and the second rotation angle shown in FIG. 4 are angles to which the main body unit 110 rotates about 90 degrees from the cutting rotation angle shown in FIG. 2 in different directions.

Thus, the cutting device 100 is configured in such a way that the blade 121 faces upward when the main body unit 110 is at the first rotation angle, and the blade 122 faces upward when the main body unit 110 is at the second rotation angle.

Although not being shown, the cutting device 100 is configured in such a way that the upper part of the main body unit 110 at the cutting rotation angle does not go down lower than a position of the upper part thereof at the first rotation angle or the second rotation angle. More specifically, for example, one or both of the lateral surfaces where the rotation shaft 111 is disposed is provided with a projecting unit which projects from the lateral surface to the outside, and when the main body unit 110 rotates and reaches the first rotation angle or the second rotation angle, the projecting unit abuts the support unit 160 so as to stop the main body unit 110. Keeping a rotation angle of the main body unit 110 by the projecting unit is an example, and hence the first rotation angle and the second rotation angle may be kept by another method.

In the case of the first rotation angle shown in FIG. 3, the blade 121 is positioned above the blade 122 and the cutting edge of the blade 121 faces downward while the blade 122 is positioned under the blade 121 and the cutting edge of the blade 122 faces upward.

In the case of the second rotation angle shown in FIG. 4, the blade 121 is positioned under the blade 122 and the cutting edge of the blade 121 faces upward while the blade 122 is positioned above the blade 121 and the cutting edge of the blade 122 faces downward. By replacing the blade 121 with another blade, namely, an unused blade, when, as shown in FIG. 4, the main body unit 110 is at the second rotation angle at which the cutting blade 121 is positioned under the blade 122, the blades 121 and 122 can be replaced with other blades safely.

Furthermore, the rotation angles of the main body unit 110 can be properly used depending on a blade (121 or 122) to be replaced with another blade. Accordingly, the blades 121 and 122 can be replaced with other blades more safely.

Next, the carrier unit 140 is described with reference to FIGS. 5 to 8.

FIGS. 5 to 8 are perspective views each showing the carrier unit 140 in the main body unit 110 at the cutting rotation angle.

The carrier unit 140 includes a sandwiching unit 141, a rotation unit 142 and a linear movement unit 143. The sandwiching unit 141 holds a booklet delivered from the delivery unit 32 of the carrier device 30. The rotation unit 142 supports the sandwiching unit 141 in such a way that the sandwiching unit 141 rotates. The linear movement unit 143 supports the rotation unit 142 in such a way that the rotation unit 142 linearly moves.

The sandwiching unit 141 includes two sandwiching members 141*a* and 141*b* each of which has a surface part which abuts a paper surface of a booklet. The sandwiching unit 141 is configured in such a way that a distance between the surface parts of the sandwiching members 141*a* and 141*b* changes. The two sandwiching members 141*a* and 141*b* move close to or away from each other so as to have a distance between the surface parts, the distance corresponding to the thickness of a booklet, thereby sandwiching the booklet. The surface parts of the two sandwiching members 141*a* and 141*b* are along the lateral surfaces X1 and X2 of the main body unit 110. That is, the sandwiching unit 141 holds a booklet in such a way that the paper surfaces of the booklet are along the lateral surfaces X1 and X2.

The rotation unit 142 supports the sandwiching member 141*a* of the sandwiching unit 141 in such a way that the sandwiching member 141*a* rotates. The rotation unit 142 includes a rotation drive unit 142*a* (shown in FIG. 9) which operates under the control of a control unit 180 (shown in FIG. 9) of the cutting device 100. The rotation unit 142 rotates the sandwiching unit 141 by drive of the rotation drive unit 142*a* and holds the sandwiching unit 141 at a predetermined rotation angle so as to control a rotation angle of a booklet held by the sandwiching unit 141.

The rotation unit 142 engages with a guide rail 143*a* disposed, in the main body unit 110, along a direction which is at right angles to a surface direction of the bottom 112 so as to linearly move along the guide rail 143*a*.

Figure 9:
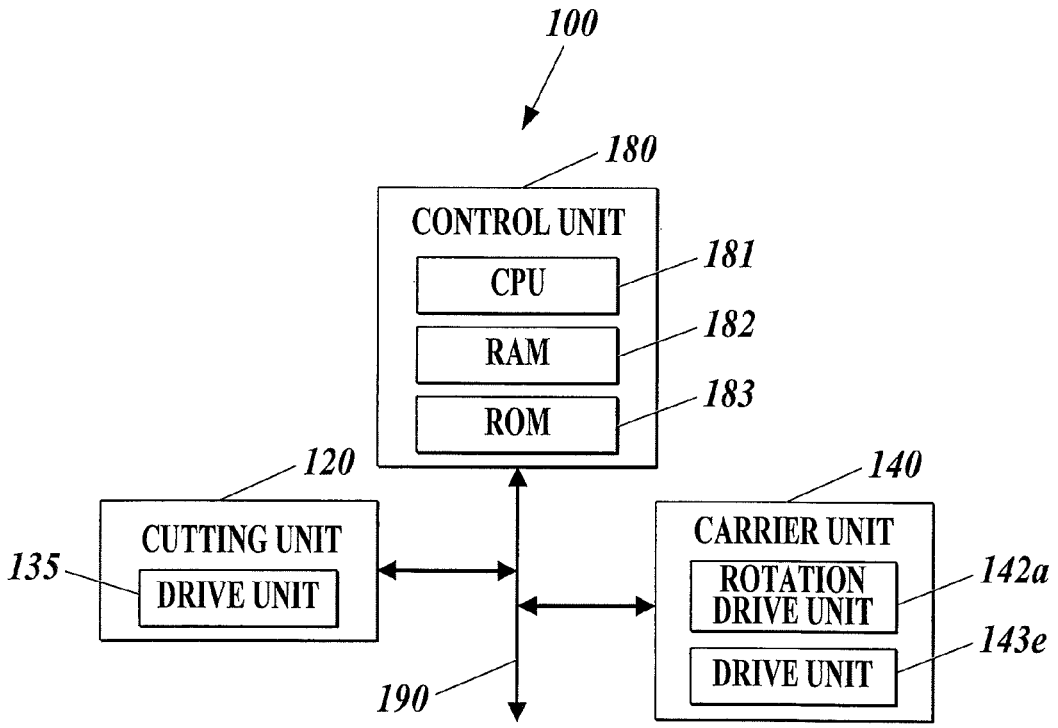
FIG. 9 is a block diagram of main components related to control of operations of the cutting device.

The linear movement unit 143 includes the guide rail 143*a*, a pulley 143*b*, a pulley 143*c*, a belt 143*d* and a drive unit 143*e* (shown in FIG. 9). The pulley 143*b* rotates on a rotation shaft thereof fixed to the rotation unit 142. The pulley 143*c* is disposed on a side opposite to a delivery opening 145 for booklets with respect to an extending direction of the guide rail 143*a*. The belt 143*d* connects the pulley 143*b*, the pulley 143*c* and the like to each other. The drive unit 143*e* linearly moves the rotation unit 142 along the guide rail 143*a* by drive of the belt 143*d*. The linear movement unit 143 linearly moves the rotation unit 142 so as to linearly move a booklet held by the sandwiching unit 141 to the delivery opening 145.

As shown in FIGS. 5 to 8, the delivery opening 145 is provided on the bottom 112 side. The delivery opening 145 is provided between the blade 121 and the blade 122 of the cutting unit 120. The components of the carrier unit 140 carry a booklet delivered from the delivery unit 32 of the carrier device 30 into the delivery opening 145, and keeps the booklet there, thereby keeping the booklet between the blade 121 and the blade 122. At the time, an edge portion of the booklet to be cut off by the cutting unit 120 is out of the main body unit 110 from the bottom 112 downward. In this state, the cutting unit 120 operates, and the blade 121 moves close to the blade 122, so that the edge portion of the booklet is cut off and drops down.

The carrier unit 140 linearly moves the booklet, edge portions of which have been cut off (cutting processing), in such a way that the booklet is away from the delivery opening 145. Then, as shown in FIG. 2, the carrier unit 140 sends out the booklet, on which the cutting processing has been performed, by using a not-shown sending-out mechanism unit.

The cutting processing performed by the cutting unit 120 includes fore-edge cutting processing and top-edge/tail-edge cutting processing. The fore-edge cutting processing is cutting processing to cut off, among the edge portions of a booklet, an edge portion of the booklet (margins of pages constituting a booklet), the edge portion being parallel to the spine of the booklet. The top-edge/tail-edge cutting processing is cutting processing to cut off, among the edge portions of a booklet, edge portions of the booklet (margins of pages constituting a booklet), the edge portions being at right angles to the spine of the booklet. There are two edge portions which are at right angles to the spine. Hence, the top-edge/tail-edge cutting processing is performed twice by rotating a booklet.

In the following, operations of the carrier unit 140 performed as the cutting processing is performed are described.

Figure 5:
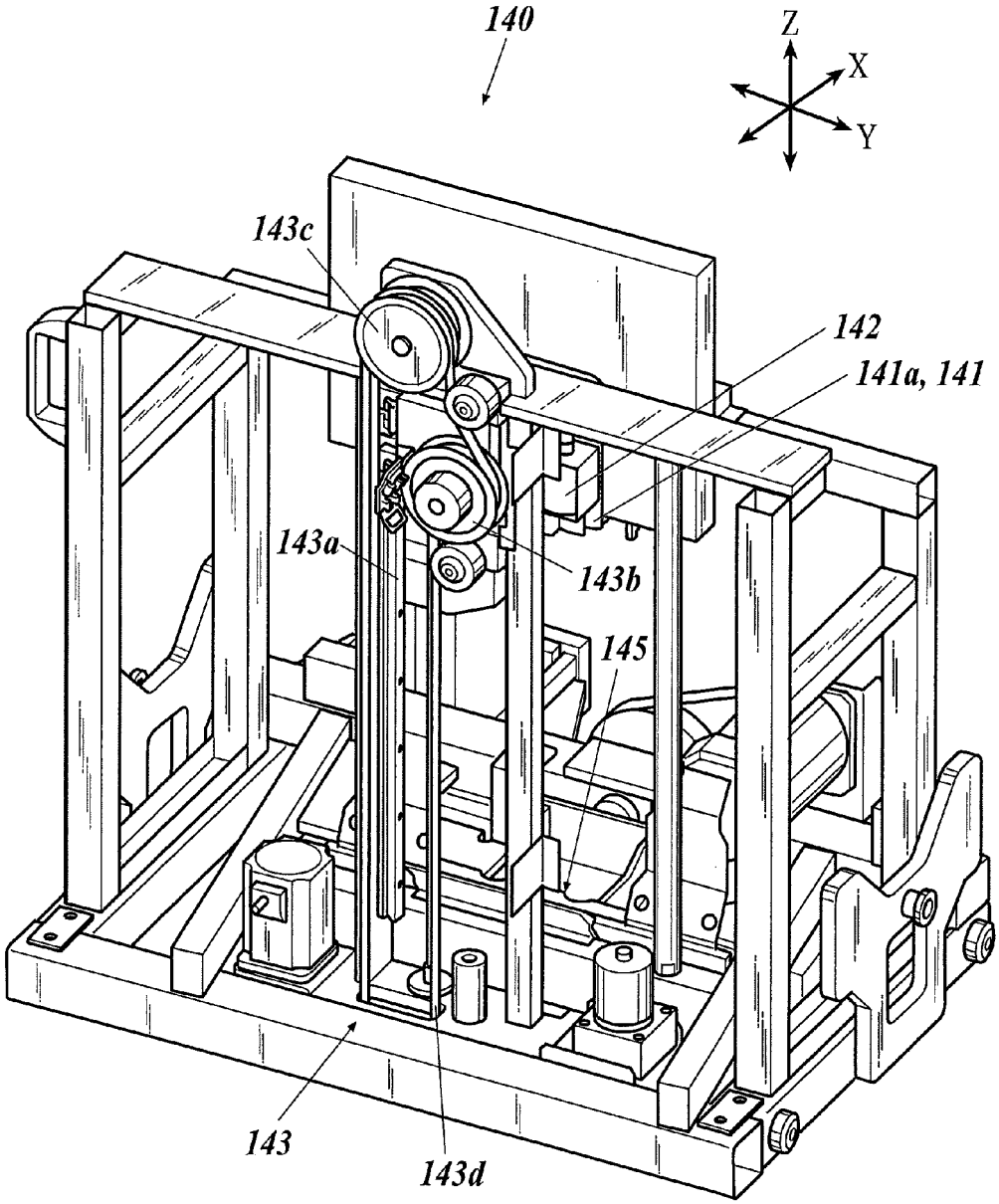
FIG. 5 is a perspective view of a carrier unit in the main body unit at a cutting rotation angle.

First, as shown in FIG. 5, the carrier unit 140 holds with the sandwiching unit 141*a* booklet delivered from the delivery unit 32 of the carrier device 30. At the time, the spine of the booklet faces the delivery opening 145.

Figure 6:
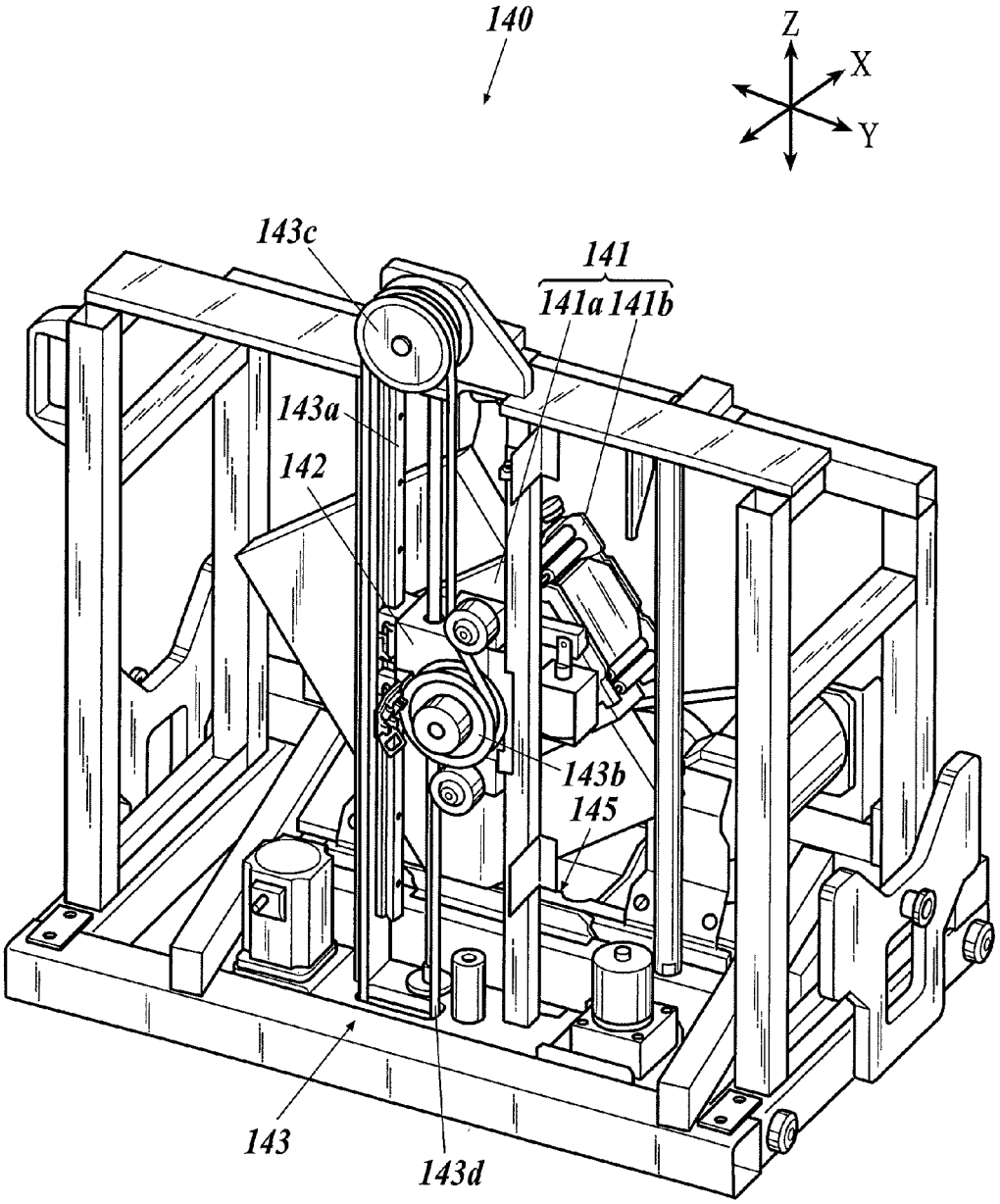
FIG. 6 is a perspective view of the carrier unit which rotates a booklet and moves the booklet downward from the state shown in FIG. 5.

Next, the carrier unit 140 linearly moves the rotation unit 142 to the delivery opening 145 while rotating the sandwiching unit 141. Consequently, as shown in FIG. 6, the booklet is carried to the delivery opening 145 while changing its orientation.

Figure 7:
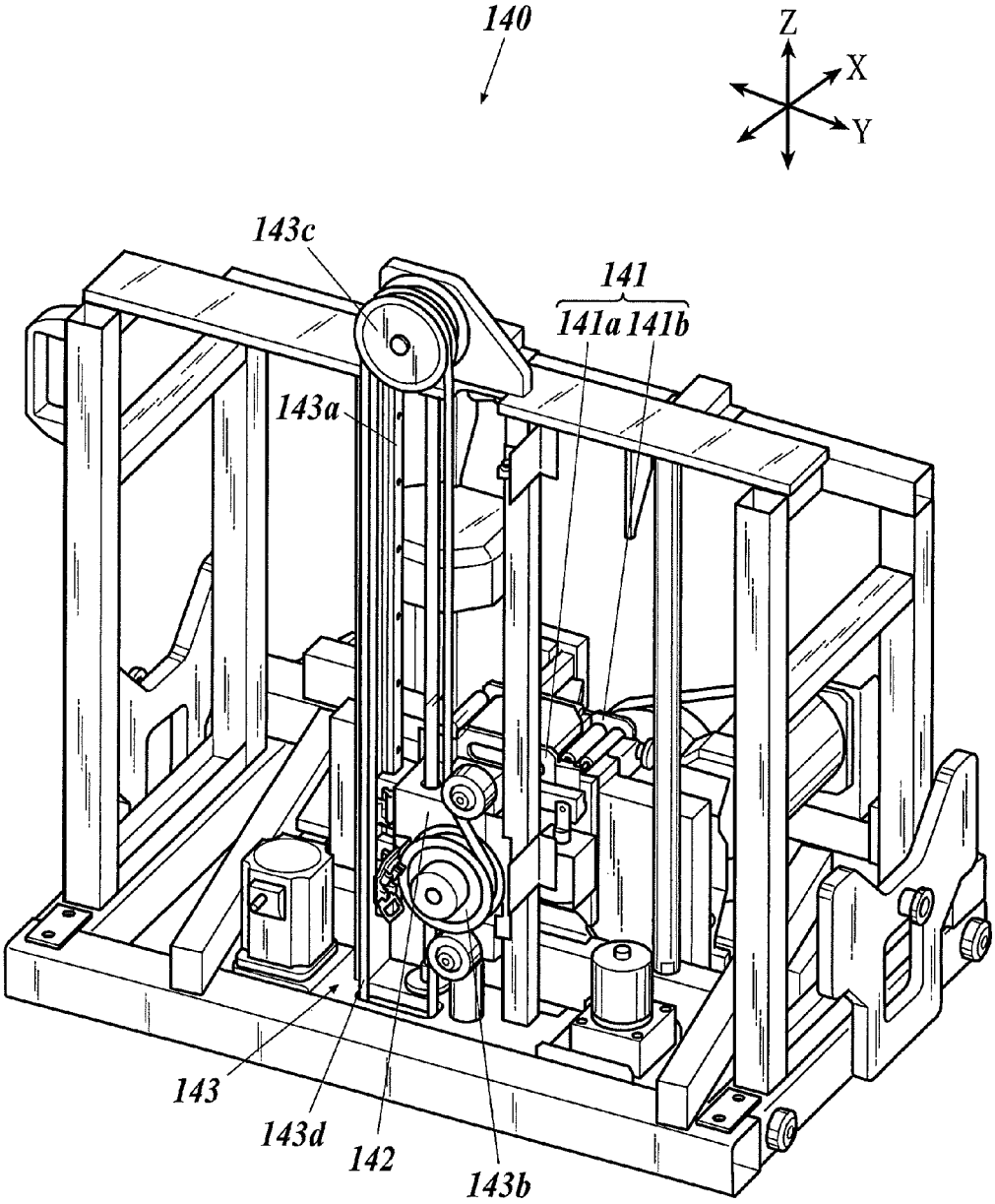
FIG. 7 is a perspective view of the carrier unit in fore-edge cutting processing.

In the case of the fore-edge cutting processing, as shown in FIG. 7, the carrier unit 140 carries a booklet into the delivery opening 145 in such a way that an edge portion of the booklet, the edge portion being parallel to the spine, faces the bottom 112.

Figure 8:
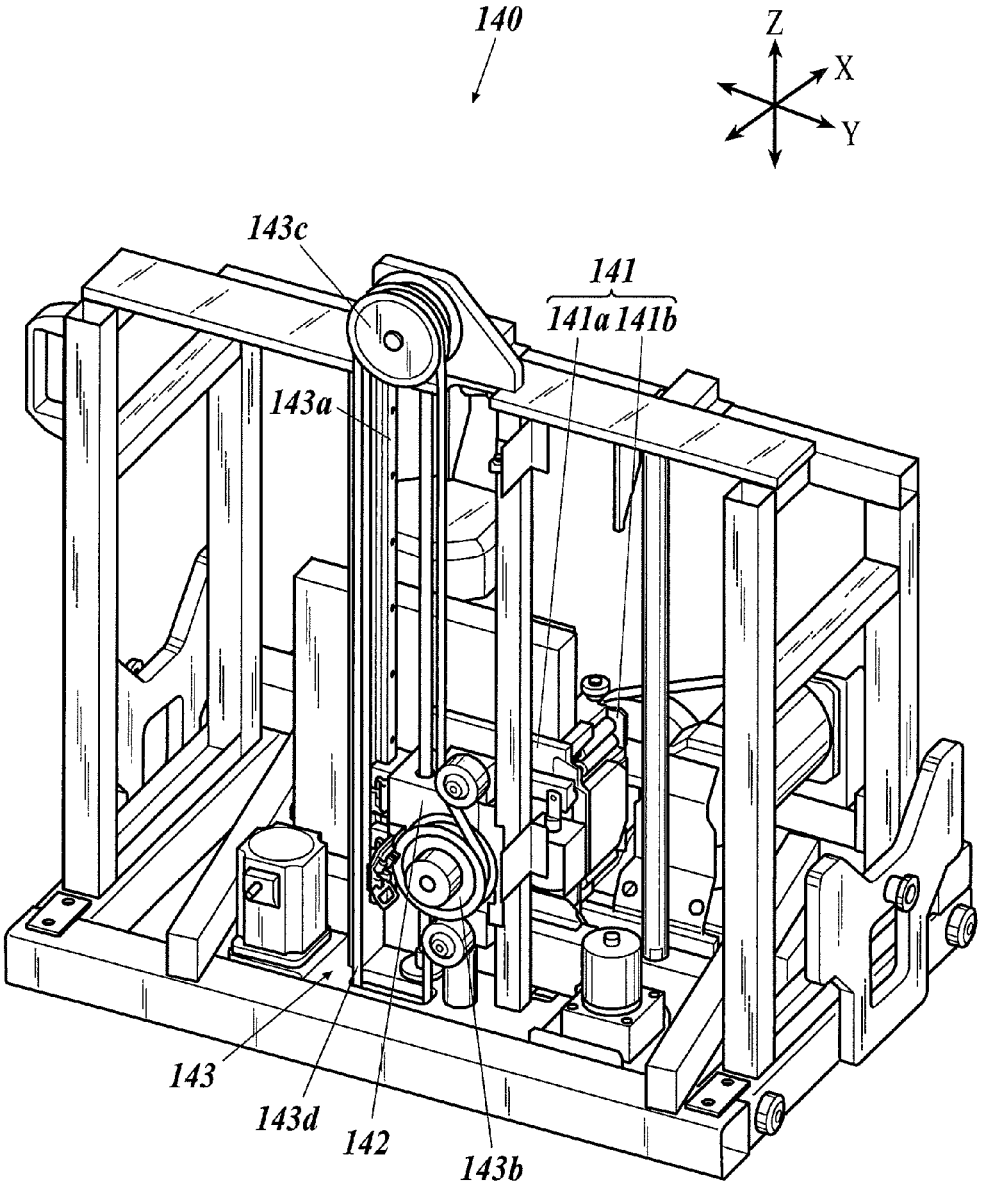
FIG. 8 is a perspective view of the carrier unit in top-edge/tail-edge cutting processing.

In the case of the top-edge/tail-edge cutting processing, as shown in FIG. 8, the carrier unit 140 carries a booklet into the delivery opening 145 in such a way that an edge portion of the booklet, the edge portion being at right angles to the spine, faces the bottom 112.

In the embodiment, the fore-edge cutting processing and the top-edge/tail-edge cutting processing are performed to cut off edge portions of a booklet in the order named. However, this is not a limitation but an example.

In the case of a no-booklet, such as a sheet of paper, an edge portion (margin) of the sheet, the edge portion being parallel to an edge portion (margin) thereof positioned between the two sandwiching members 141*a* and 141*b* of the sandwiching unit 141, is cut off by the fore-edge cutting processing, and two edge portions (margins) of the sheet, the edge portions being at right angles to the edge portion thereof positioned between the two sandwiching members 141*a* and 141*b* thereof, are cut off by the top-edge/tail-edge cutting processing.

FIG. 9 is a block diagram of main components related to control of operations of the cutting device 100.

As shown in FIG. 9, the cutting device 100 includes the control unit 180 which controls operations of the components (units and the like) of the cutting device 100. The control unit 180 includes a CPU 181, a RAM 182 and a ROM 183. The CPU 181 reads programs and/or data in accordance with processing contents from a storage device, such as the ROM 183, so as to perform processing in accordance with the read programs and/or data, and controls operations of the components, such as the drive unit 135, the rotation drive unit 142*a* and the drive unit 143*e*, which are connected to each other and to the control unit 180 via a bus 190.

As described above, according to the image forming system 1 of the embodiment, the main body unit 110 of the cutting device 100 rotates to expose the blades 121 and 122 of the cutting unit 120 on a lateral side. Accordingly, a replacement operation of the blades 121 and 122 of the cutting unit 120 disposed on the lateral side by the rotation of the main body unit 110 can be performed from the lateral side of the cutting device 100. Accordingly, the blades 121 and 122 can be more easily replaced with other blades.

Furthermore, the main body unit 110 can change the cutting rotation angle, at which an edge portion of a booklet to be cut off by the cutting unit 120 comes out of the main body unit 110 downward so as to cut off the edge portion downward, and the no-cutting rotation angle, at which the blades 121 and 122 of the cutting unit 120 are exposed on a lateral side. Consequently, the blades 121 and 122 of the cutting device 100, which can easily separate an edge portion to be cut off from a booklet by dropping the edge portion when the cutting processing is performed on the booklet, can be easily replaced with other blades at the time when the cutting processing is not performed.

Furthermore, the cutting unit 120 has the two blades 121 and 122, the cutting edges of which face each other, and the main body unit 110 can change the first rotation angle, at which the cutting edge of the blade 121 faces upward, and the second rotation angle, at which the cutting edge of the blade 122 faces upward, as the no-cutting rotation angle. Accordingly, by placing the main body unit 110 at a rotation angle at which the cutting edge of one of the blades 121 and 122, the one to be replaced with another blade, faces upward, the blades 121 and 122 can be replaced with other blades more safely.

Furthermore, the first rotation angle and the second rotation angle are rotation angles to which the main body unit 110 rotates about 90 degrees from the cutting rotation angle in different directions. Accordingly, only by changing the directions to rotate the main body unit 110, a blade, the cutting edge of which faces upward, can be changed between the blades 121 and 122.

The embodiment described herein is to be considered in all respects illustrative and not limitative. The scope of the present invention is to be indicated by the appended claims, rather than by the foregoing description, and all changes which come within the meaning and range of equivalency of the claims are intended to be embraced therein.

Figure 10:
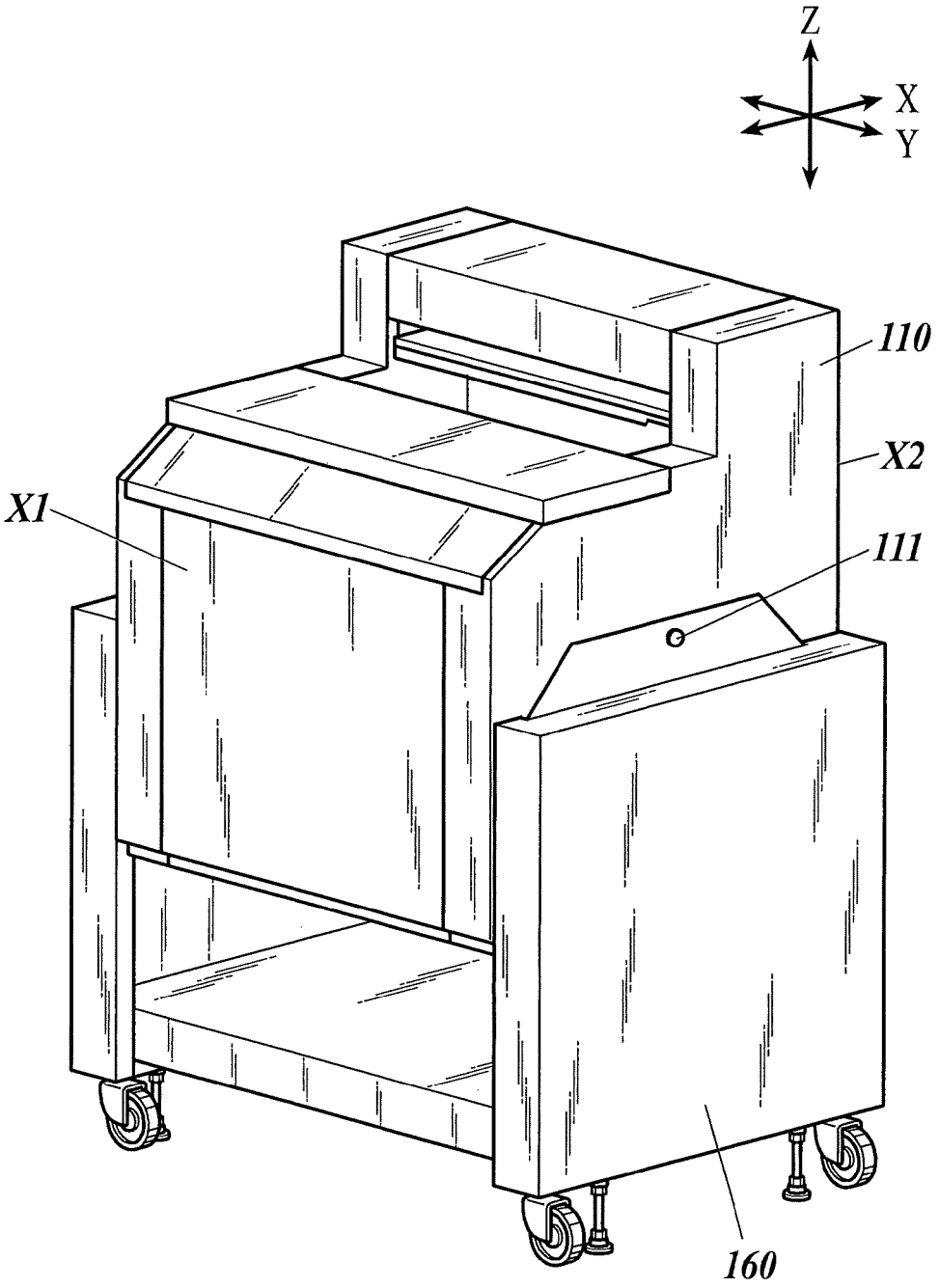
FIG. 10 is a perspective view of the cutting device provided with a rotation shaft near the center of gravity of the main body unit.

For example, in the embodiment, the rotation shaft 111 of the main body unit 110 is disposed near the bottom 112. However, this is not a limitation but an example. As shown in FIG. 10, the rotation shaft 111 may be disposed at a higher position than the position thereof shown in FIG. 2. The support unit 160 supports the main body unit 110 in such a way that the main body unit 110 rotates via the rotation shaft 111 which passes through the center of gravity of the main body unit 110 or near the center of gravity thereof. Accordingly, the main body unit 110 can be supported more stably. In addition, because a weight balance of the cutting device 100 does not change depending on the change of rotation angles even when the main body unit 110 rotates, the rotation angles can be changed more stably.

Furthermore, in the embodiment, there are two rotation angles as the no-cutting rotation angle, namely, the first rotation angle and the second rotation angle. However, this is not a limitation but an example. As long as there is at least one rotation angle at which the blade 121 (and the blade 122) of the cutting unit 120 is exposed on a lateral side so that the blade 121 can be easily seen when the blade 121 is replaced with another blade, the number of rotation angles as the no-cutting rotation angle is not limited. For example, the main body unit 110 may be configured to rotate 180 degrees or 360 degrees from the cutting rotation angle so that the cutting unit 120 is exposed on the upper side.

Furthermore, it is unnecessary for the no-cutting rotation angle to be different about 90 degrees from the cutting rotation angle as long as the no-cutting rotation angle is a rotation angle at which the blades 121 and 122 can be safely replaced with other blades. Furthermore, not being limited to the first rotation angle and the second rotation angle, a multiple number of steps for rotation angles in one rotational direction of the main body unit 110 may be provided so as to change the rotation angles. Accordingly, the best rotation angle for a maintenance person to perform the replacement operation can be used in accordance with various conditions, such as the height of the maintenance person. Alternatively, there may be no step for rotation angles. In this case, it is preferable to provide a stopper unit to hold the main body unit 110 at a desired rotation angle (a clutch mechanism unit to keep a rotation angle of the main body unit 110, for example).

Furthermore, in the embodiment, the two blades 121 and 122 are provided. However, this is not a limitation but an example. As long as sheets of paper can be cut by at least one blade, there is no limitation. Here, the blade can be safely replaced with another blade by making the cutting edge of the blade face upward when the cutting unit 120 is exposed on a lateral side by the rotation of the main body unit 110.

Furthermore, it is unnecessary that the cutting edge of a blade to be replaced with another blade faces upward as long as safety of a maintenance person who replaces the blade can be ensured. For example, the blade may be covered with a cover member, and replaced with another blade.

Furthermore, in the embodiment, the main body unit 110 is expected to be manually rotated with respect to the support unit 160. However, this is not a limitation but an example. The main body unit 110 may be rotated by power of a motor or the like. Alternatively, even in the case where the main body unit 110 is manually rotated, a mechanical component to change rotation angles, such as a lever, may be provided.

The components (units and the like) of the image forming system 1 described in the embodiment are not limitations but examples. Hence, for example, the cutting device 100 may have some or all of the components (configuration) of the carrier device 30.

This application is based upon and claims the benefit of priority under 35 USC 119 of Japanese Patent Application No. 2012-096263 filed on Apr. 20, 2012, the entire disclosure of which, including the description, claims, drawings and abstract, is incorporated herein by reference in its entirety.

What is claimed is:

1. A cutting device comprising:

a main body unit including a cutting unit on a lower side, the cutting unit which cuts off an edge portion of paper;

a support unit which supports the main body unit in such a way that the main body unit rotates, wherein the main body unit exposes a blade of the cutting unit at least on a lateral side by rotating and the main body unit makes the edge portion, which is cut off by the cutting unit, come out of the main body unit in a downward direction so that the cut off edge portion is a downward facing edge portion.

2. The cutting device according to claim 1, wherein the blade faces upward in response to the main body unit rotating to expose the cutting unit on the lateral side.

3. The cutting device according to claim 2, wherein the blade includes two blades which face each other, in response to the main body unit being at a first rotation angle, one of the blades faces upward, and in response to the main body unit being at a second rotation angle, the other of the blades faces upward.

4. The cutting device according to claim 3, wherein the first rotation angle and the second rotation angle are rotation angles to which the main body unit rotates about 90 degrees from a reference rotation angle of the main body unit in different directions, the reference rotation angle at which the cutting unit is disposed on the lower side.

5. The cutting device according to claim 1, wherein the support unit supports the main body unit via a rotation shaft which passes through the center of gravity or near the center of gravity of the main body unit in such a way that the main body unit rotates.

6. An image forming system comprising:

an image forming device which performs image formation on paper; and a cutting device comprising:

a main body unit including a cutting unit on a lower side, the cutting unit which cuts off an edge portion of paper;

a support unit which supports the main body unit in such a way that the main body unit rotates, wherein the main body unit exposes a blade of the cutting unit at least on a lateral side by rotating and the main body unit make the edge portion, which is cut off by the cutting unit, come out of the main body unit in a downward direction so that the cut off edge portion is a downward facing edge portion, wherein the cutting device cuts off the edge portion of the paper on which the image formation is performed by the image forming device.

* * * * *